US009347192B1

(12) United States Patent
Smith

(10) Patent No.: US 9,347,192 B1
(45) Date of Patent: May 24, 2016

(54) FECES REMOVER WITH QUICK-RELEASE HEAD

(71) Applicant: Thomas Smith, Weldon, CA (US)

(72) Inventor: Thomas Smith, Weldon, CA (US)

( * ) Notice: Subject to any disclaimer, the term of this patent is extended or adjusted under 35 U.S.C. 154(b) by 0 days.

(21) Appl. No.: 14/588,264

(22) Filed: Dec. 31, 2014

(51) Int. Cl.
*A01K 29/00* (2006.01)
*E01H 1/12* (2006.01)

(52) U.S. Cl.
CPC ..... *E01H 1/1206* (2013.01); *E01H 2001/128* (2013.01)

(58) Field of Classification Search
CPC ..... E01H 1/1206; E01H 2001/128; E01H 2001/122; A01K 23/005; A01D 9/00
USPC ..... 294/1.4, 1.3, 1.5, 50, 52, 179, 55.5, 56, 294/51; 56/400.01, 400.16, 400.21
See application file for complete search history.

(56) References Cited

U.S. PATENT DOCUMENTS

| | | | | | |
|---|---|---|---|---|---|
| 3,688,483 | A * | 9/1972 | Hamilton | A01D 7/10 | 15/1.7 |
| 5,335,952 | A * | 8/1994 | Clapper | E01H 1/1206 | 294/1.4 |
| 5,388,878 | A * | 2/1995 | Smith | B65G 7/12 | 294/15 |
| 5,562,318 | A * | 10/1996 | McBroom | A01K 1/0114 | 294/1.4 |
| 6,003,913 | A * | 12/1999 | Flumiani | E01H 1/1206 | 294/1.4 |
| D437,462 | S * | 2/2001 | Whall | 294/1.4 | |
| 7,214,199 | B1 * | 5/2007 | Yastrebov | A01K 23/005 | 600/573 |
| 7,914,056 | B1 * | 3/2011 | Peterman | A01K 1/0114 | 294/1.3 |
| 8,172,287 | B1 * | 5/2012 | Watson | A01D 9/00 | 294/55.5 |
| 8,955,893 | B1 * | 2/2015 | Stern | E01H 1/1206 | 294/1.4 |
| 2004/0090073 | A1 * | 5/2004 | Edwards | A47L 13/52 | 294/1.3 |
| 2004/0164568 | A1 * | 8/2004 | Diehl | A01K 23/005 | 294/1.4 |
| 2009/0058114 | A1 * | 3/2009 | Diehl | E01H 1/1206 | 294/1.4 |
| 2012/0193273 | A1 * | 8/2012 | Chrostowski | A01D 7/08 | 209/419 |
| 2013/0062895 | A1 * | 3/2013 | Groth | A01K 29/00 | 294/1.3 |
| 2014/0260172 | A1 * | 9/2014 | Bowden | A01D 7/06 | 56/400.21 |
| 2015/0020493 | A1 * | 1/2015 | Stein | A01D 7/06 | 56/400.16 |

FOREIGN PATENT DOCUMENTS

| | | | | |
|---|---|---|---|---|
| ES | 102012103071 | A1 * | 7/2013 | E01H 1/1206 |
| GB | WO 9320285 | A1 * | 10/1993 | E01H 1/1206 |

* cited by examiner

*Primary Examiner* — Gabriela Puig
(74) *Attorney, Agent, or Firm* — Matthew C. McCartney, Esq.; Eastman & McCartney LLP

(57) ABSTRACT

The Feces Remover with Quick-Release Head provides a tool to retrieve feces and directly deposit the feces into a disposable bag without the need to simultaneously handle the Feces Remover and disposable bag. The Feces Remover includes a handle formed with a storage compartment having a quick-release head receiver with an attached quick-release head at one end and a cap used to enclose the storage compartment at the opposite end. A plunger placed at the bottom of the storage compartment is attached to the cap. As the cap is removed from the handle, the plunger is pulled up along the storage compartment and brings all the items held within towards the uncapped end of the storage container. To remove feces a disposable bag is directly attached to the quick-release head receiver and quick-release head where the opening of the quick-release head allows feces to be directly deposited into the bag.

17 Claims, 13 Drawing Sheets

FECES REMOVER WITH QUICK-RELEASE HEAD

FIELD OF INVENTION

The invention relates generally to cleaning tools and more particularly, but not exclusively, to a feces remover.

BACKGROUND OF THE INVENTION

Typically, feces removers are simple scoops which scoop up feces and are used to deposit the feces into a disposable bag. This requires a user to simultaneously handle the bag and the feces remover as the user pours the feces from the scoop into the bag. Accomplishing this task is difficult for a single person as the person is required to handle the scooper and the bag simultaneously, ensuring that the bag is open to receive the feces. Oftentimes the bag collapses on itself and the user will have to readjust the opening of the bag. Further, the user is required to be in close proximity of the feces as one hand is used to handle the bag and the other hand is handling the scoop. Therefore, the user is typically only a hand length away from the feces.

The feces removers are typically bulky as the scoop component protrudes from the handle perpendicularly. This creates an overall footprint of the feces removal equal to the length of the scoop. To store the typical feces remover the storage area needs at least the foot print area of the scoop component. This takes up valuable space in the user's storage area in which other bulkier items may require. Additionally, the storage area of the feces remover is typically in an area with no easy access to disposable bags. Therefore, to get the bag the user must leave the storage area to retrieve the bag and return.

In light of the above, it will be advantageous to provide a feces remover with the capability to directly deposit feces into a bag, removing the need to simultaneously handle the feces remover and the disposable bag. It would be further advantageous to provide a feces remover with a quick-release head enabling a more compact configuration for easier storage. It would further be advantageous to provide a storage compartment within the feces remover to store disposable bags.

SUMMARY OF THE INVENTION

The Feces Remover with Quick-Release Head of the present invention provides a tool to retrieve feces and directly deposit the feces into a disposable bag without the need to simultaneously handle the Feces Remover and disposable bag. The Feces Remover includes a handle formed with a storage compartment having a quick-release head receiver attached at one end. Attached to the opposite end of the handle is a cap used to enclose the storage compartment to keep items within. Attached to the cap is a plunger located at the bottom of the storage compartment. As the cap is removed from the handle, the plunger is pulled up along the storage compartment and pulls all the items held within the storage compartment towards the uncapped end of the storage container.

The quick-release head receiver is a steel rectangle bar formed into a pentagon frame with an open center. The pentagon shaped steel bar has a base, sides and a mounting plate at each of the two ends. The mounting plates are formed with retaining clips at the ends. The quick-release head receiver is attached to the handle by the mounting plates and the retaining clips provide an area in which a disposable grocery shopping bag may be temporarily attached by slipping the bag between the retaining and the handle. Once the disposable bag is attached to the quick-release head receiver and handle, the bag encloses the quick-release head receiver and the opening of the pentagon shaped steel bar opens directly into the interior of the grocery bag.

A quick-release head is attached with a quick-release clip to the quick-release head receiver. The quick-release head includes a base assembly with a plurality of prongs attached at one end and one or more quick-release clips attached on the opposite end. In an embodiment, the plurality of prongs have at least two outer prongs and a plurality of inner prongs. The quick-release head is formed with an open center. The prongs are spaced apart and configured with outer prong bends and inner prong bends to funnel feces towards the inner prongs, allowing a user to more easily direct feces from the inner prongs through the open center. The prongs at the edge provide obstructions to serve as barrier to prevent debris from falling out the sides. The base assembly is rigidly attached to the quick-release clips. The quick-release clips allows the removable attachment of the quick-release head to the quick-release head receiver. By detaching the quick-release head from the quick-release head receiver, the Feces Remover may be configured into a more compact configuration for storage or packaging.

By attaching the disposable grocery bag to the mounting plates of the head receiver, the Feces Remover is configured to pick up feces and directly deposit the feces into the disposable bag in a single motion without the need to simultaneously handle the disposable bag and the Feces Remover. When attached, the disposable bag encloses the head receiver and the opening of the pentagon shaped steel bar opens directly into the interior of the grocery bag. As the feces is picked up by the prongs of the feces removal head, the prongs naturally direct the feces towards the opening of the bag due to the shape of the prongs. By manipulating the Feces Remover, the feces is directly deposited into the bag without any further intervention and without risk of the feces coming into contact with the user or the handles of the bag.

BRIEF DESCRIPTION OF THE FIGURES

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE FIGURES

Figure 1:
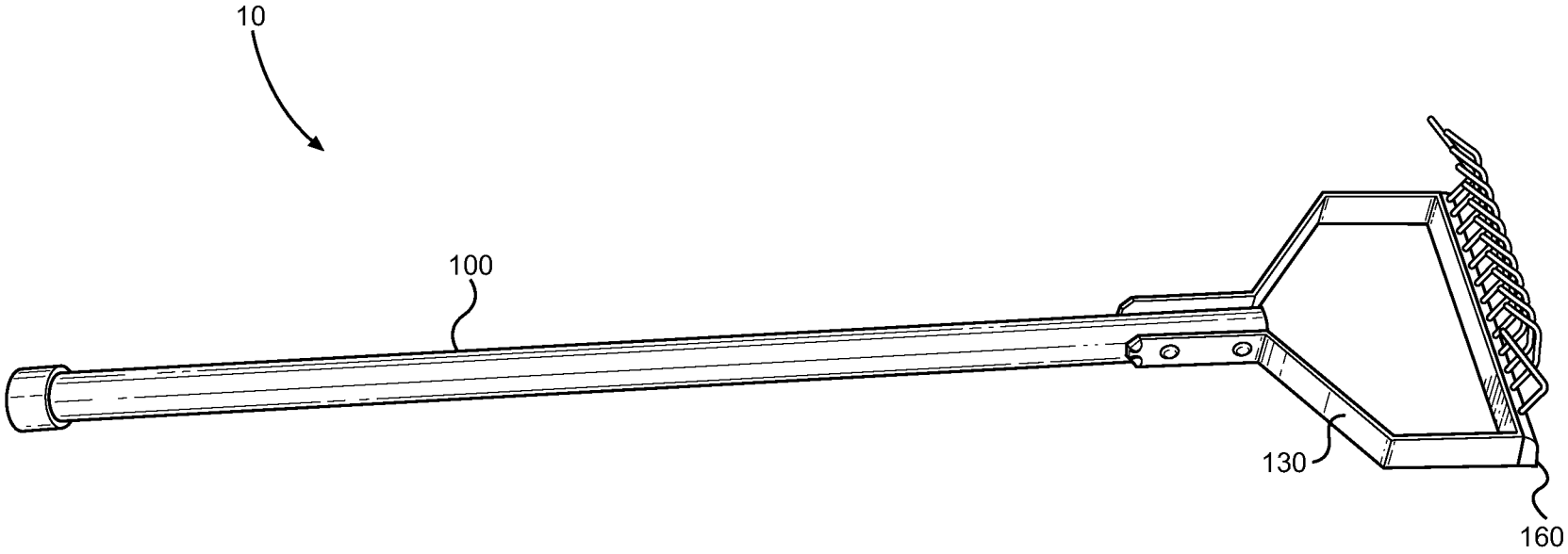
FIG. 1 is a perspective view of the Feces Remover with Quick-Release Head with a handle, a quick-release head receiver and a quick-release head.

Referring initially to FIG. 1, the Feces Remover with Quick-Release Head of the present invention is shown and generally designated 10. The Feces Remover with Quick-Release Head (hereinafter referred to as "Feces Remover") includes a handle 100, a quick-release head receiver 130 and a quick-release head 160. The quick-release head receiver 130 is fixedly attached to the handle 100 and the quick-release head 160 is removably attached to the quick-release head receiver 130 with the use of quick-release clips 170 and 188 to form the Feces Remover 10.

Figure 2:
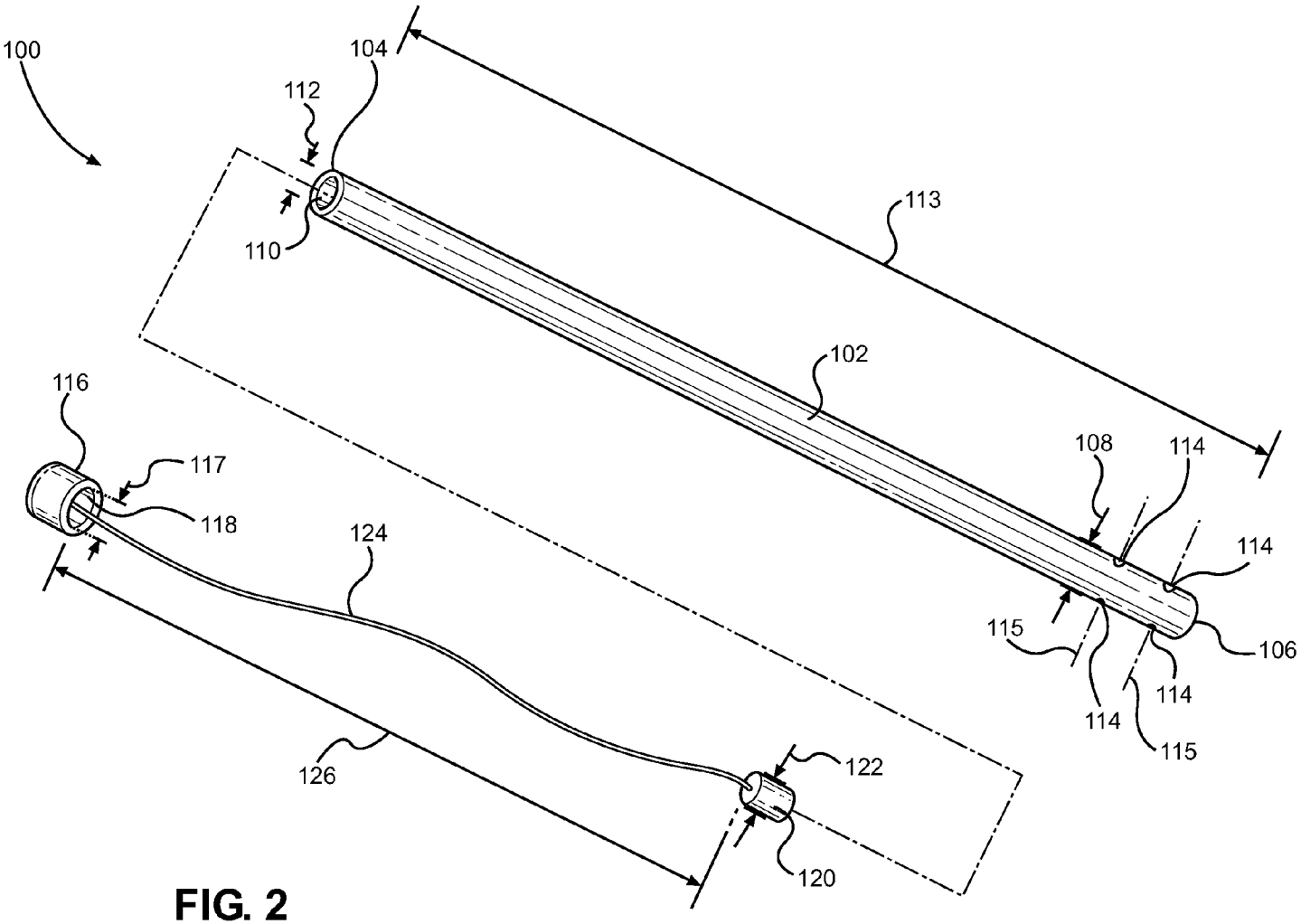
FIG. 2 is an exploded perspective view of the handle of the present invention including a handle, a cap and a plunger.

Referring now to FIG. 2, an exploded view of the handle 100 is shown. The handle 100 is a tube 102 having a first end 104 and a second end 106. The tube 102 has an exterior diameter 108 and formed with an internal bore 110 having an internal diameter 112. Formed on the tube 102 adjacent the second end 106 is are mounting holes 114. In the preferred embodiment the mounting holes 114 include four holes, wherein a pair of holes is placed on either side of the tube 102 and vertically aligned along alignment line 115 to create a direct path from the first pair of holes through the second pair of holes.

A cap 116 formed with a bore 118 to receive the first end 104 of the tube 102 is removably attached to the first end 104 of the tube 102. The bore 118 of the cap 116 is configured to form an interference fit with the exterior of the tube 102. As a result, the bore 118 has a slightly larger diameter 117 than the exterior diameter 108 of the tube 102. This allows the cap 116 to fit over the tube 102 and enclose the interior bore 110 at the first end 104 while providing enough friction force for the cap 116 to grip onto the tube 102. The interior bore 110 may be used as a storage compartment to store any number of items such as plastic grocery bags. The interior bore 110 is sized to accommodate the storage of disposable grocery shopping bags while the exterior diameter 108 is small enough to allow the Feces Remover 10 to take up a minimal amount of footprint area when stored. To access the interior bore 110 defining the storage space, the user removes the cap 116 from the front end 104 of the tube 102. To close the interior bore 110 defining the storage space, the user covers the first end 104 of the tube 102 with the cap 116.

To ensure the material stored within the internal bore 110 is easily removable, a plunger 120 is slidably received by the internal bore 110. The plunger 120 is a cylinder having a diameter 122. The diameter 122 of the plunger 120 is smaller than the interior diameter 112 of the internal bore 110. This allows the plunger 120 to easily traverse the internal bore 110. Attached to one end is a connector 124 connecting the plunger 120 to the cap 116. The connector 124 is a string with a length 126 equal to length 113 of the tube 102. The plunger 120 is placed within the internal bore 110 towards the second end 106 of the tube 102. The plunger 120 encloses the second end 106 of the tube 102, preventing any items stored within the internal bore 110 from falling through the internal bore 110 of the tube 102. Additionally, the plunger 120 acts as a movable platform. As the cap 116 is removed from the handle 100, the connected plunger 120 is pulled up along internal bore 110 and moves all the items held within the internal bore 110 towards the first end 104 of the tube 102. This ensures that all of the material held within the storage container is removed from the storage space.

Figure 3B:
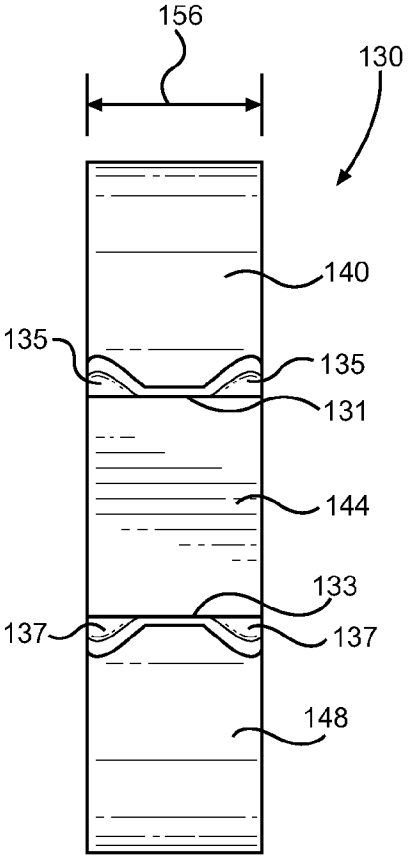
FIG. 3*b* is a side view of the quick-release head receiver showing the profile of the first and second retaining clips.
Figure 3A:
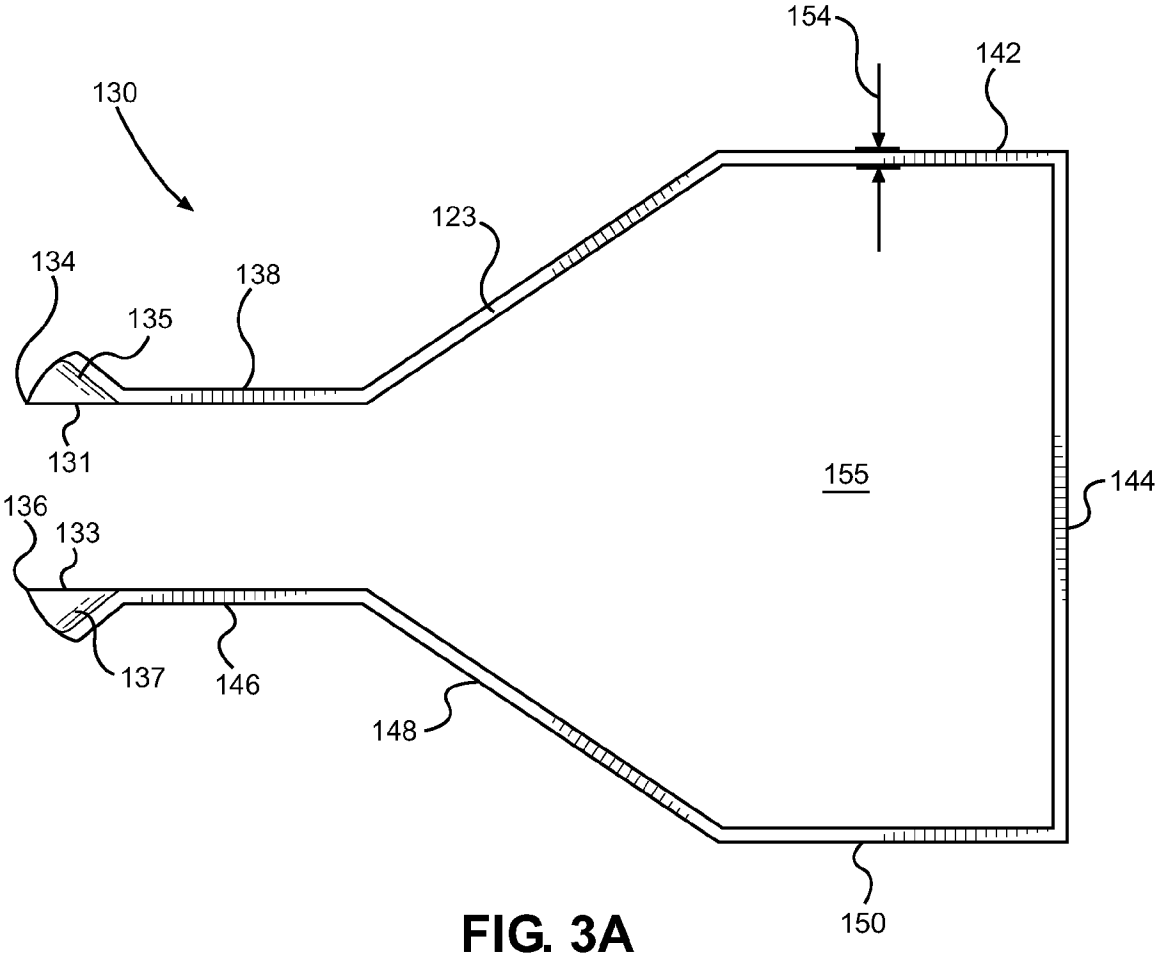
FIG. 3*a* is a top view of the quick-release head receiver.
Figure 3C:
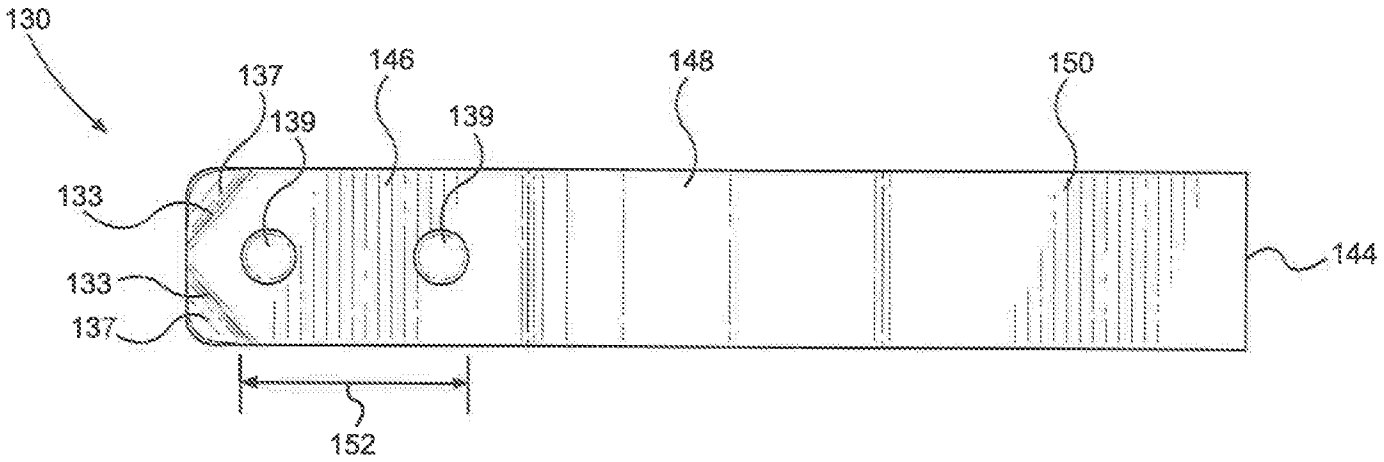
FIG. 3*c* is a side view of the quick-release head receiver showing mounting holes.
Figure 4:
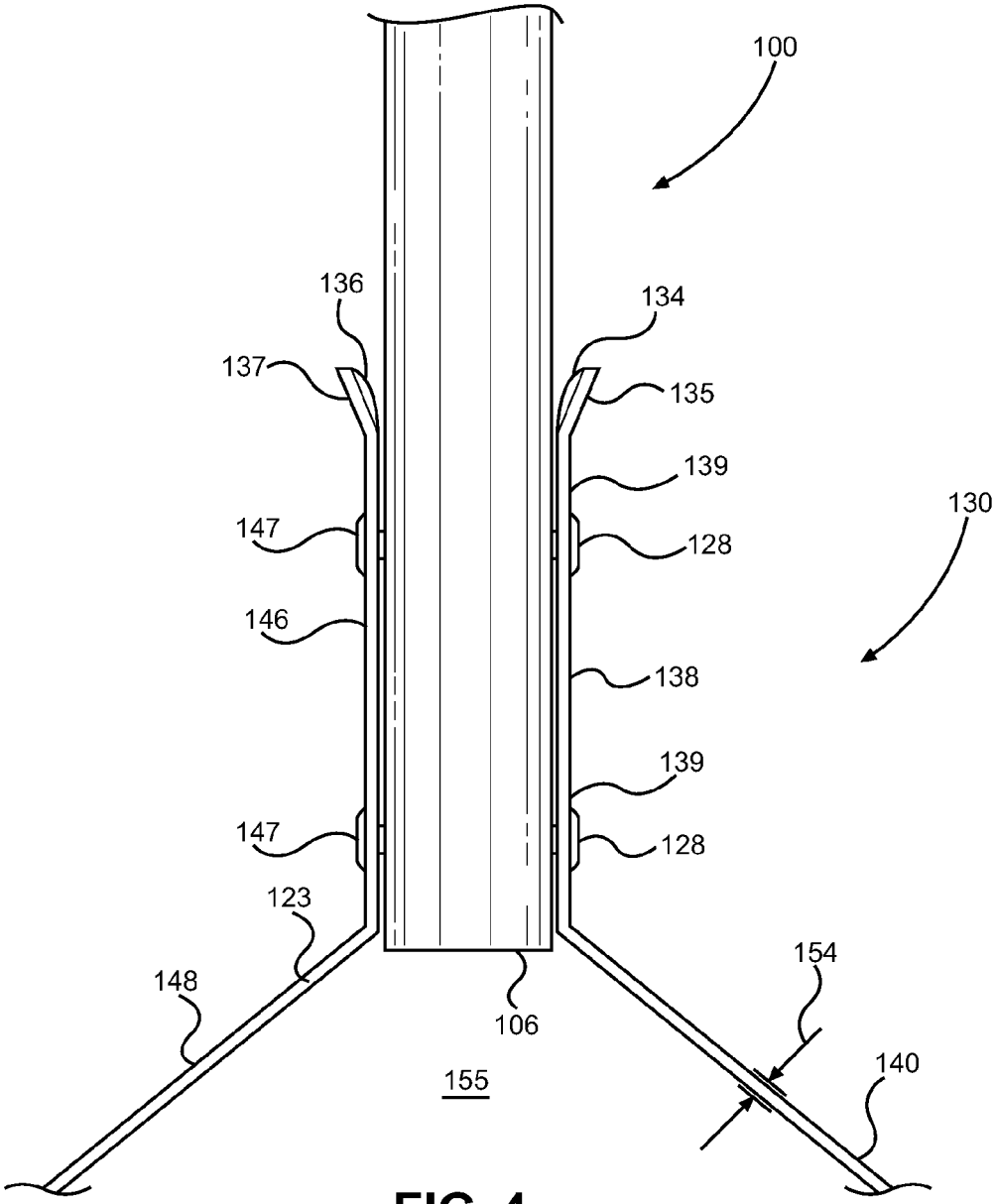
FIG. 4 is a partial top view of the quick-release head receiver mounted to the handle with fasteners.

Referring now to FIGS. 3A through 3C, in conjunction with FIG. 4, the quick-release head receiver 130 is constructed of a steel rectangular bar 123 having a first end 134 and a second end 136 removably attached to mounting holes 114 of the handle 100 with fasteners 128 and formed into the shape of a pentagon. The steel rectangular bar 123 has a thickness 154 and width 156. The steel rectangular bar 123 is formed as a rectangular wire frame with an open center 155 where the first end 134 of the steel rectangular bar 123 is a straight section formed as a first mounting plate 138 and the second end 136 is a straight section formed as a second mounting plate 146. The first mounting plate 138 transitions into a first angled side 140 and then into a first vertical side 142. The second mounting plate 146 transitions into a second angled side 148 and then into a second vertical side 150. A base 144 connects between the first vertical side 142 and the second vertical side 150.

The first mounting plate 138 and the second mounting plate 146 are formed with mounting holes 139 and 147, respectively. Mounting holes 139 and 147 includes two holes formed into the first mounting plate 138 and the second mounting plate 146, respectively. The mounting holes 139 and 147 correspond to the mounting holes 114 of the handle 100. This allows fasteners 128 to be inserted through the mounting holes 139 and 147 directly into the mounting holes 114 of the handle 100, thereby fastening the first mounting plate 138 and the second mounting plate 146 to the handle 100. The first mounting plate 138 and the second mounting plate 146 are tightly pressed against the handle 100. The mounting holes 139 and 147 are separated a distance 152 from the base 144. The base 144 and the mounting plates 138 and 146 are disposed perpendicular to each other, thereby allowing the positioning of the base 144 parallel with the floor as a user grips onto the handle 100 for use.

The first mounting plate 138 and the second mounting plate 146 are further formed with a first retaining edge 135 and a second retaining edge 137, respectively. The first end 134 and second end 136 of the steel rectangular bar 123 are flared outward, making the first retaining edge 135 and second retaining edge 137. The first retaining edge 135 and second retaining edge 137 allow a bag to be wedged in between mounting plates 138 and 146 and the handle 100. The first retaining edge 135 and the second retaining edge 137 provide enough surface area to slide a bag between the first retaining edge 135 and the handle 100 and the second retaining edge 137 and the handle 100. The force of the first retaining edge 135 and the second retaining edge 137 pressed against the handle 100 with the bag between creates sufficient friction force to hold the bag in place.

Figure 5:
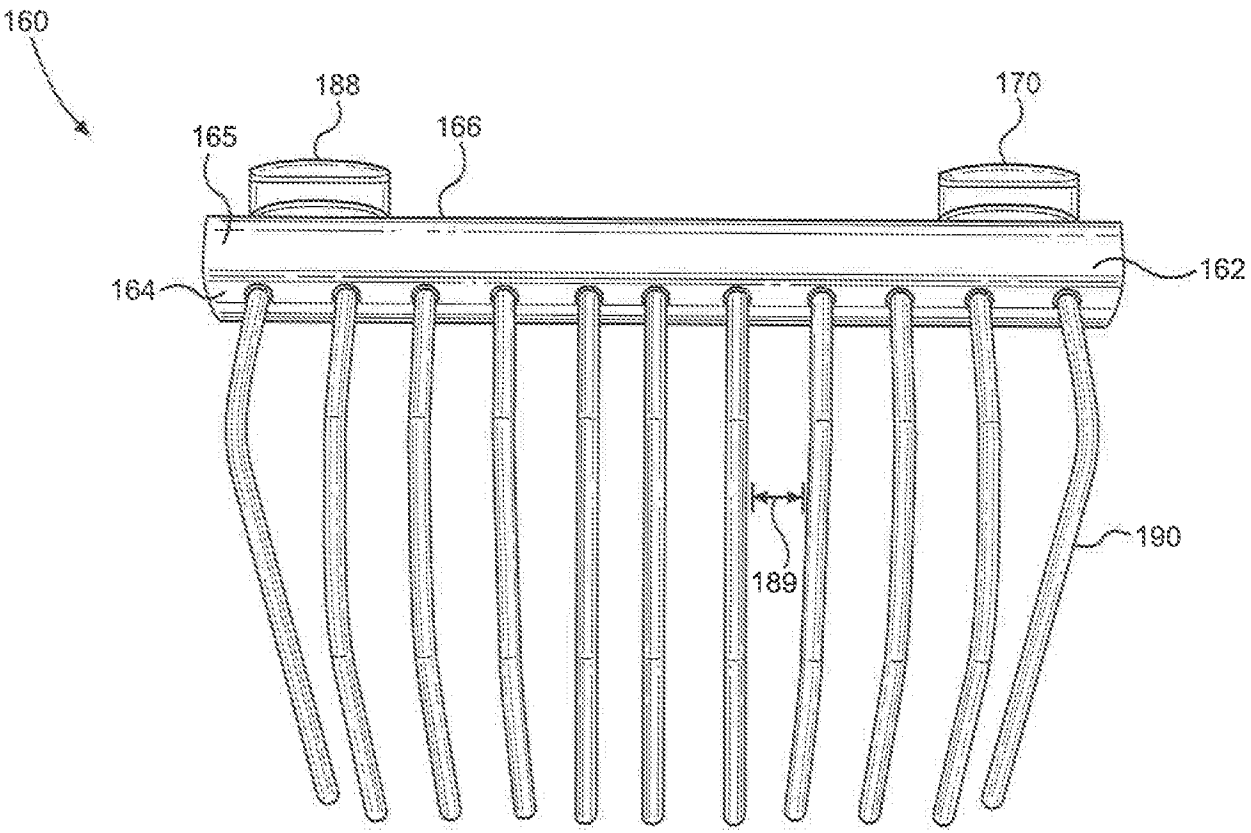
FIG. 5 is a bottom plan view of the quick-release head.

Referring now to FIG. 5, the quick-release head 160 is attached with a first quick-release clip 170 and a second quick release clip 188 to the base 144 (Shown in FIGS. 3A through 3B) of the quick release feces head receiver 130. The first curved surface 164 of the base assembly 162 is formed with a plurality of prongs 190. The prongs 190 are steel rods fixedly attached to and protruding from first curved surface 164 of the base assembly 162. The prongs 190 are equally spaced apart with a gap 189 along the base assembly 162. The gap 189 between each of the prongs 190 is dimensioned large enough to allow the prongs 190 to comb through different materials without getting caught while small enough to prevent feces from falling through the gaps 189.

Figure 6:
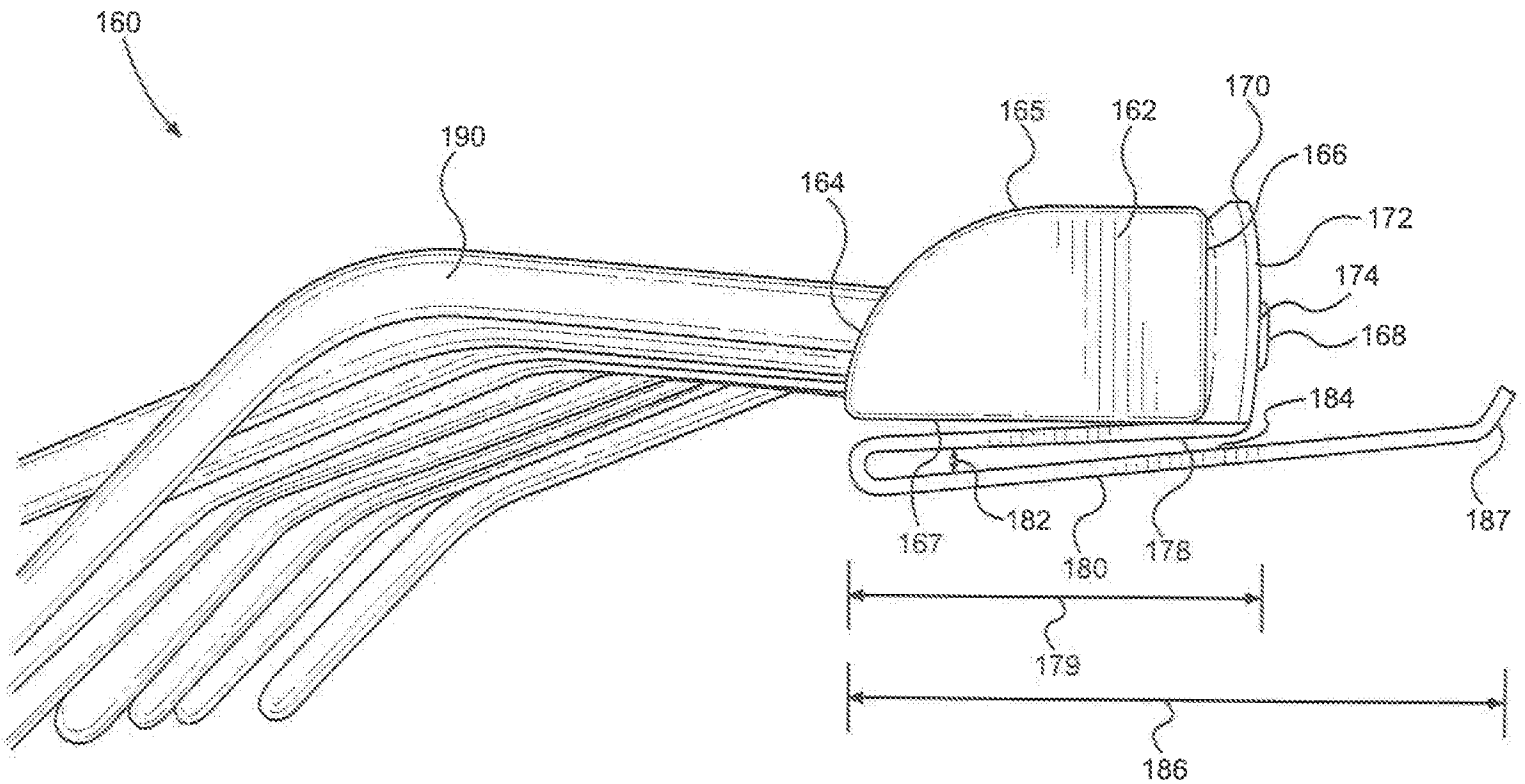
FIG. 6 is a side view of the quick-release head.

Referring now to FIG. 6, the quick-release head 160 includes a base assembly 162 having a rectangular shape with a first curved surface 164, a first flat surface 165, a second flat surface 166, and a third flat surface 167. The first quick-release clip 170 and a second quick release clip 188 are attached to the second flat surface 166. The number of quick-release clips is not meant to be limiting and it is contemplated that one or more quick-release clips may be used to attach the quick-release head 160 to the quick-release head receiver 130. The first quick-release clip 170 and the second quick-release clip 188 (shown in FIG. 5) are substantially similar and therefore only the first quick-release clip 170 will be described in detail, wherein the second quick-release clip 188 fully incorporates the detailed description of the first quick-release clip 170.

The first quick-release clip 170 is formed with a base assembly mount 172, a base assembly support 178, a head receiver base clamp 180, and a clip detent 187. The base assembly mount 172 is formed with a base assembly mounting hole 174. The base assembly mounting hole 174 is sized to receive a fastener 168 to fasten the base assembly 162 to the base assembly mount 172. The base assembly mounting hole 174 is utilized to attached the base assembly 162 to the first quick-release release clip 170. Formed on the second flat surface 166 of the base assembly 162 are corresponding mounting holes 169 (not shown). The base assembly 162 is attached to the base assembly mount 172 by aligning the mounting holes 169 and 174, respectively, and attaching it with a fastener 168 such as a screw, a bolt, a rivet or other mechanical fastening means. The use of mechanical fasteners is not meant to be limiting. It is contemplated that the first quick-release clip 170 may attach to the base assembly 162 through the use of adhesives, welds, or any other attachment means known in the art.

The base assembly support 178 is perpendicular and integrally formed to the base assembly mount 172. The base assembly support 178 provides a flat supporting surface in which the third flat surface 167 of the base assembly 162 contacts to ensure the base assembly 162 is properly seated into the base assembly mount 172 for proper alignment of the base assembly mounting holes 174, keeping the base assembly 162 and attached prongs 190 at the proper position. Further, the base assembly support 178 absorbs a portion of the forces acting on the quick-release head 160, relieving the fastener 168 from absorbing all of forces.

The head receiver base clamp 180 is formed adjacent and opposite from the base assembly support 178. A gap 182 is formed between the surface of the head receiver base clamp 180 and the base assembly support 178, where the gap 182 is sized smaller than the base thickness 154 of the quick-release head receiver 130. By sizing the gap 182 smaller than the base thickness 154, when the base 144 is fit in the gap 182 it creates an interference fit. The interference fit creates a friction force, ensuring that the base 144 is held firmly within the head receiver base clamp 180. Further formed on the head receiver base clamp 180 are center detents 184 in approximately the center of the head receiver base clamp 180. The detent 184 protrudes inwards towards the head assembly support 178. The detent is formed to be received by the indent of the base 144 of the quick-release head receiver 130. This provides a further obstruction in which the base 144 must overcome to be removed from the quick-release clips 170 and 188.

The head receiver base clamp 180 has a length 186 longer than the base assembly support 178 having a length 179 and slightly longer than the width 156 of the base 144 of the quick-release head 130. The edge of the head receiver base clamp 180 is formed with a head receiver base clamp detent 187. The head receiver base clamp detent 187 is an angled edge, angled towards the base assembly support 178. The head receiver base clamp detent 187 creates an additional obstruction in which the base 144 of the quick-release head receiver 130 will need to overcome for the quick-release clamps clips 170 and 188 to be removed.

The first quick-release clip 170 and the second quick-release clip 188 are steel rectangular bars formed into a shape having the head assembly mount 172, the head assembly support 178, the head receiver base clamp 180, and the head receiver base clamp detent 187. It is contemplated that the clamp may be formed of a similar material having comparable physical properties. The first quick-release clip 170 and the second quick-release clip 188 may be made of various other types of metal, composite materials, polymers, or plastics without departing from the spirit and scope of the invention.

Figure 7A:
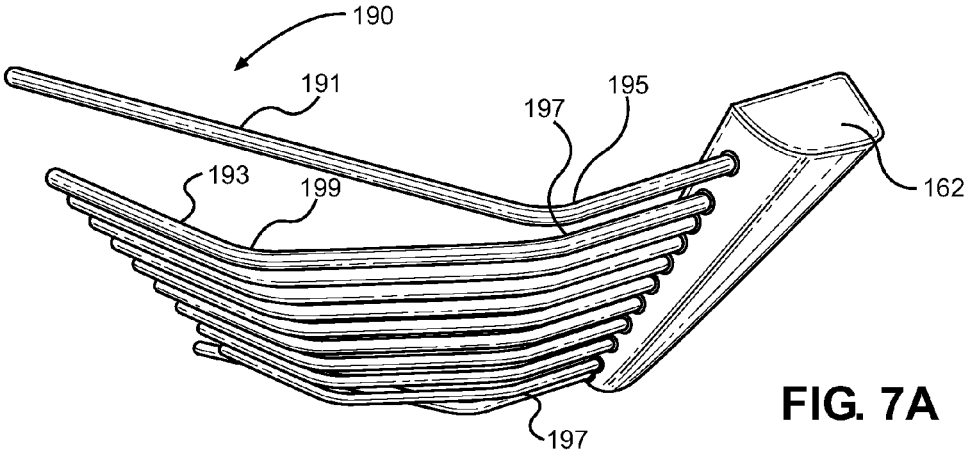
FIG. 7*a* is a side perspective view of the quick-release head showing two outer prongs each having a first outer prong bend and a plurality of inner prongs each having a first inner prong bend and a second inner prong bend.
Figure 7B:
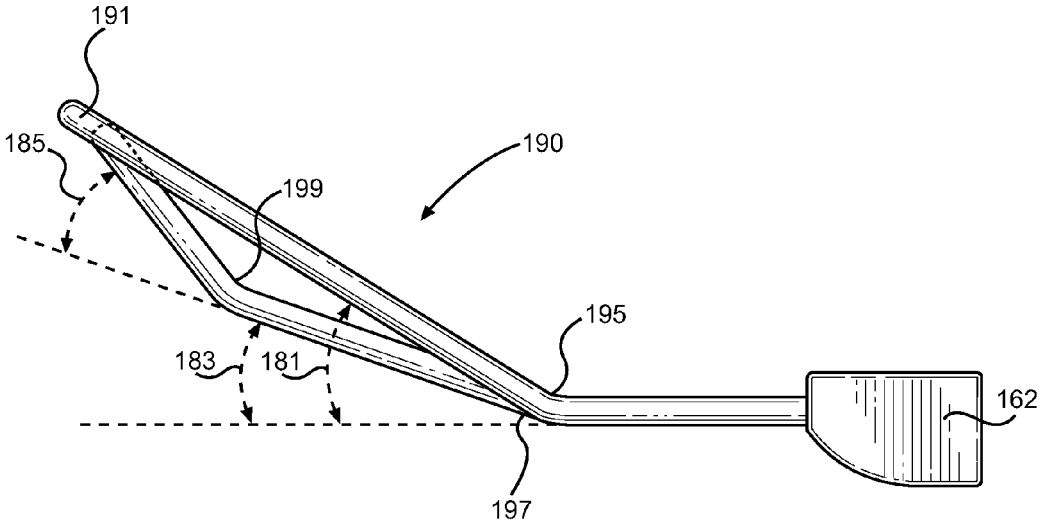
FIG. 7*b* is a side view of the quick-release head shown in FIG. 7*a* and showing an outer prong bend angle greater than either a first inner prong bend angle or a second inner prong bend angle and showing outer prong bend angle less than the sum of the first inner prong bend angle and the second inner prong bend angle.

Referring now to FIGS. 7A through 7C, three different embodiments of prongs 190 are generally shown.

In an embodiment shown in FIGS. 7A and 7B, the prongs 190 consist of outer prongs 191 and inner prongs 193. The outer prongs have a first outer prong bend 195 with a first outer prong bend angle 181. The inner prongs 193 have a first inner prong bend 197 and a second inner prong bend 199, each having a corresponding first inner prong bend angle 183 and a second inner prong bend angle 185. The first inner prong bend 197 and second inner prong bend 199 act to create a profile to hold feces on the inner prongs 193 while the first outer prong bend 195 enables the outer prongs 191 to prevent feces from rolling off the inner prongs 193. The profile can be modified through simple modification to the bend angles. As can be seen in FIG. 7B, the first outer prong bend angle 181 is large than first inner prong angle 183. However, the sum of first inner pong angle 183 and second inner prong angle 185 is greater than first outer prong bend angle.

Figure 8A:
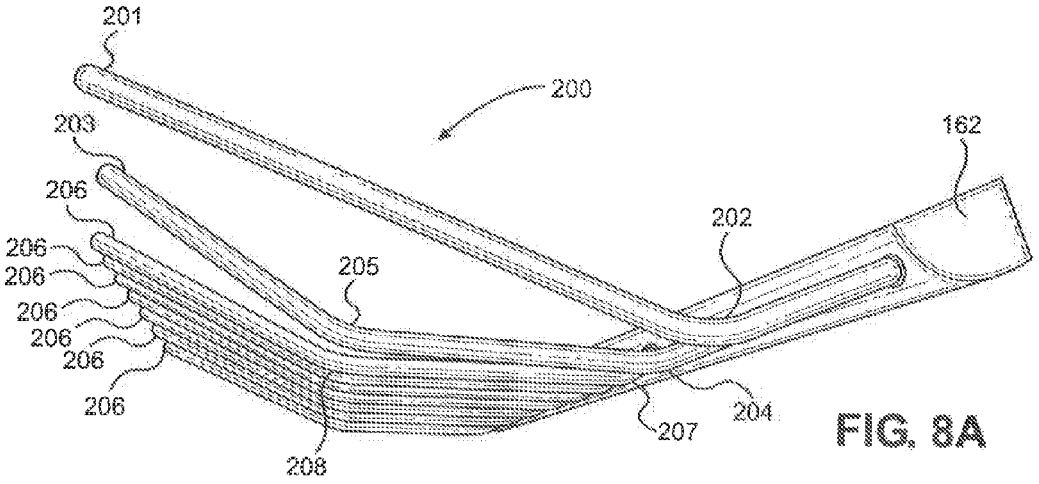
FIG. 8*a* is a side perspective view of an alternative embodiment of the quick-release head showing two first outer prongs each having a first outer prong bend, two second outer prongs each having a first outer prong bend and a second outer prong bend and a plurality of inner prongs each having a first inner prong bend and a second inner prong bend where the second outer prong bend of the second outer prongs has a larger bend angle than the second inner prong bend of the inner prongs.
Figure 8B:
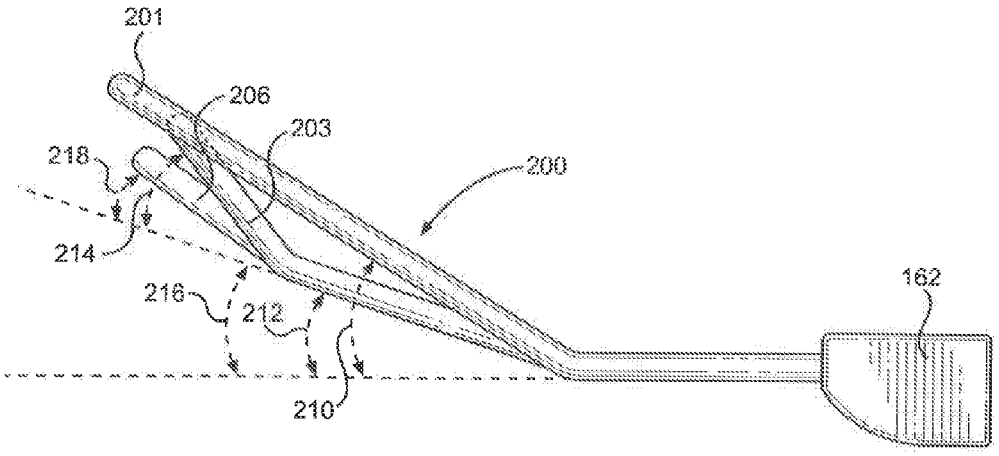
FIG. 8*b* is a side view of the quick-release head shown in FIG. 8*a* and showing an outer prong bend angle greater than a first middle prong angle, a second middle prong angle, a first inner prong angle or a second inner prong angle, but less than the sum of the first middle prong angle and the second middle prong angle and showing the sum of the first inner prong angle and the second inner prong angle greater than the sum of the first middle prong angle and the second middle prong angle.

In an alternative embodiment shown in FIGS. 8A and 8B, the prongs 200 have outer prongs 201 with a first outer prong bend 202, middle prongs 203 with a first middle prong bend 204 and a second middle prong bend 205, and inner prongs 206 with first inner prong bend 207 and second inner prong bend 208. The first outer prong bend 202 has a first outer prong bend angle 210, the first middle prong bend 204 has a first middle prong bend angle 212, the second middle prong bend 205 has a second middle prong bend angle 214, the first inner prong bend 207 has a first inner prong bend angle 216 and the second inner prong bend 208 has a second inner prong bend angle 218. The first outer prong bend angle 210 is larger than either the first middle prong bend angle 212 or the first inner prong bend angle 216. The sum of the first middle prong bend angle 212 and the second middle prong bend angle 214 is larger than the first outer prong bend angle 210. The sum of the first inner prong bend angle 216 and the second inner prong bend angle 218 is larger than the sum of the first middle prong bend angle 212 and the second middle prong bend angle 214.

Figure 9A:
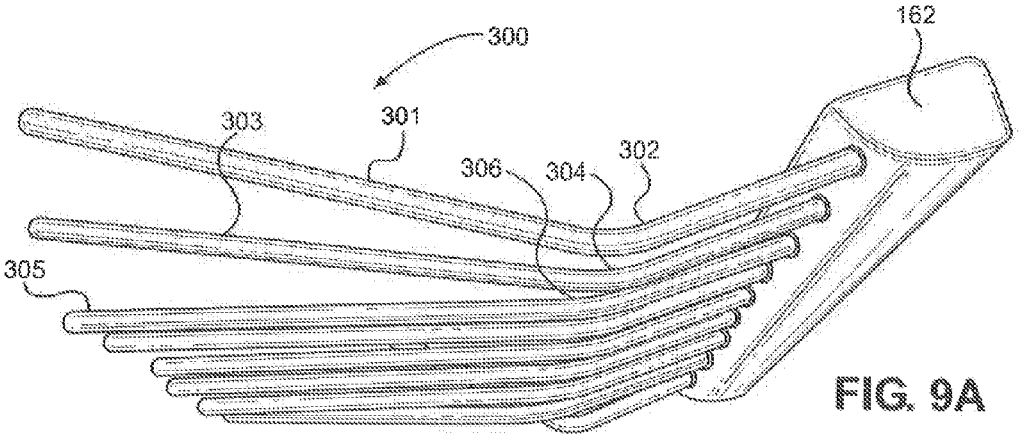
FIG. 9*a* is a side perspective view of an alternative embodiment of the quick-release head showing two first outer prongs each having a first outer prong bend, two middle prongs each having a middle prong bend and a plurality of inner prongs each having an inner prong bend.
Figure 9B:
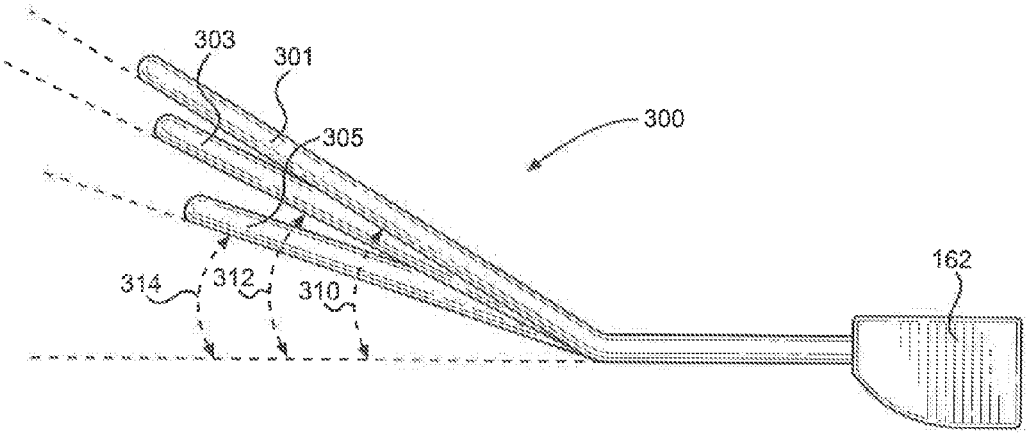
FIG. 9*b* is a side view of the quick-release head shown in FIG. 9*a* and showing an outer prong bend angle greater than a middle prong bend angle and a middle prong bend angle greater than an inner prong bend angle.

In an alternative embodiment shown in FIGS. 9A and 9B, prongs 300 have outer prongs 301 each with an outer prong bend 302, middle prongs 303 each with a middle prong bend 304, and inner prongs 305 each with an inner prong bend 306. Outer prong bend 302 has an outer prong bend angle 310, middle prong bend 304 has a middle prong bend angle 312 and inner prong bend 306 has an inner prong bend angle 314. Outer prong bend angle 310 is larger than either the middle prong bend angle 312 or the inner prong bend angle 314. The middle prong bend angle 312 is larger than the inner prong bend angle 314. The various bends 302, 304 and 306 along with corresponding bend angles 310, 312 and 314 cooperate to ensure that a feces is guided to the inner prongs 305.

It is to be appreciated that any number of combination of number of bends and bend angles in the prongs 190, 200 or 300 can be utilized create a curved profile in the prongs 190, 200 or 300 in order to stabilize feces on the prongs 190, 200 or 300 and to assist user into directing feces from the prongs 190, 200 or 300 into a bag.

Figure 10:
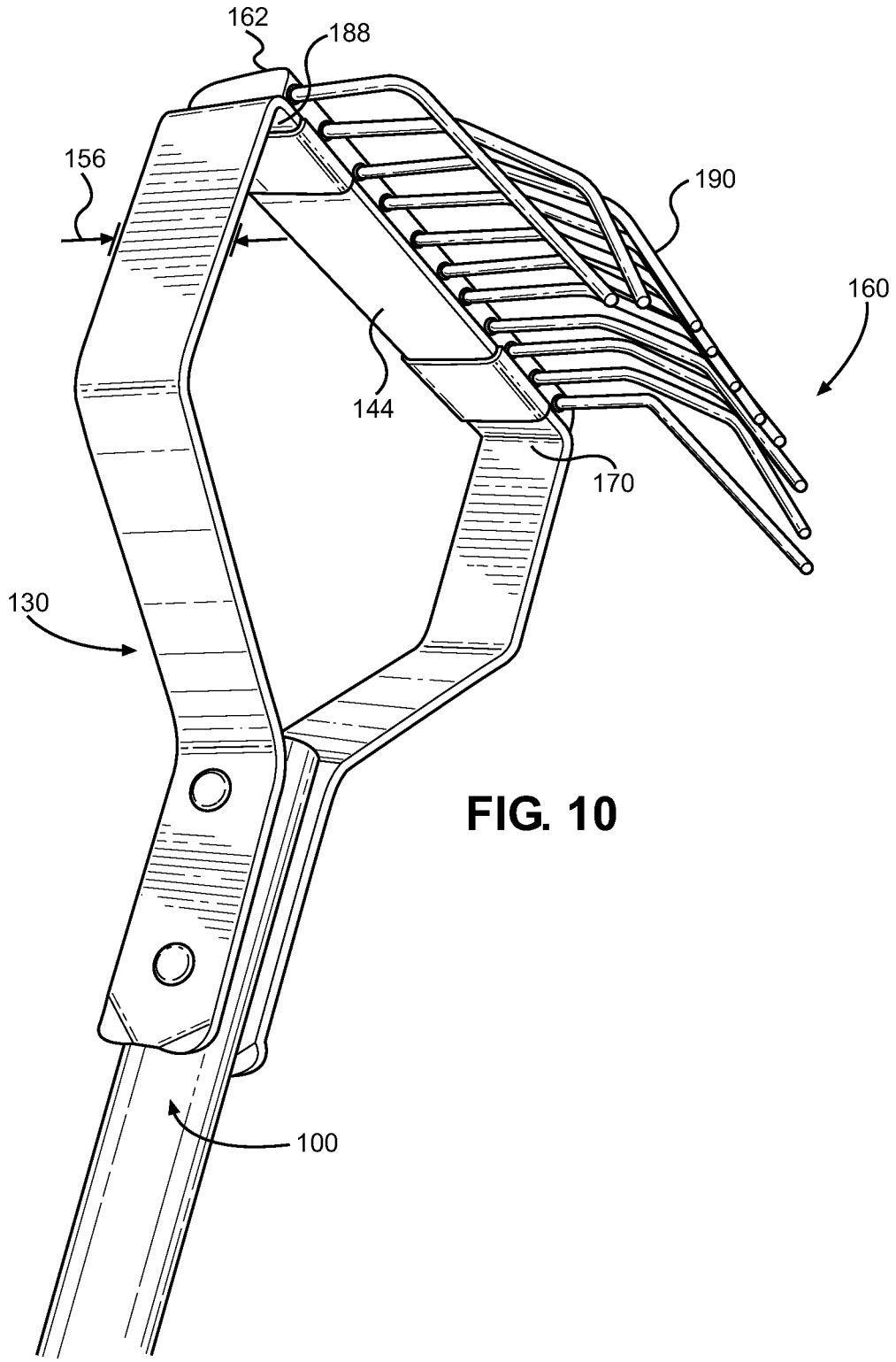
FIG. 10 is a bottom perspective view of the quick-release head attached to the quick-release head receiver with the use of quick-release clips.

Referring now to FIG. 10, the quick-release head 160 is shown removably attached to the quick-release head receiver 130 with the use of first and second quick-release clips 170 and 188. Once so attached, the Feces Remover 10 is ready to be used.

Figure 11:
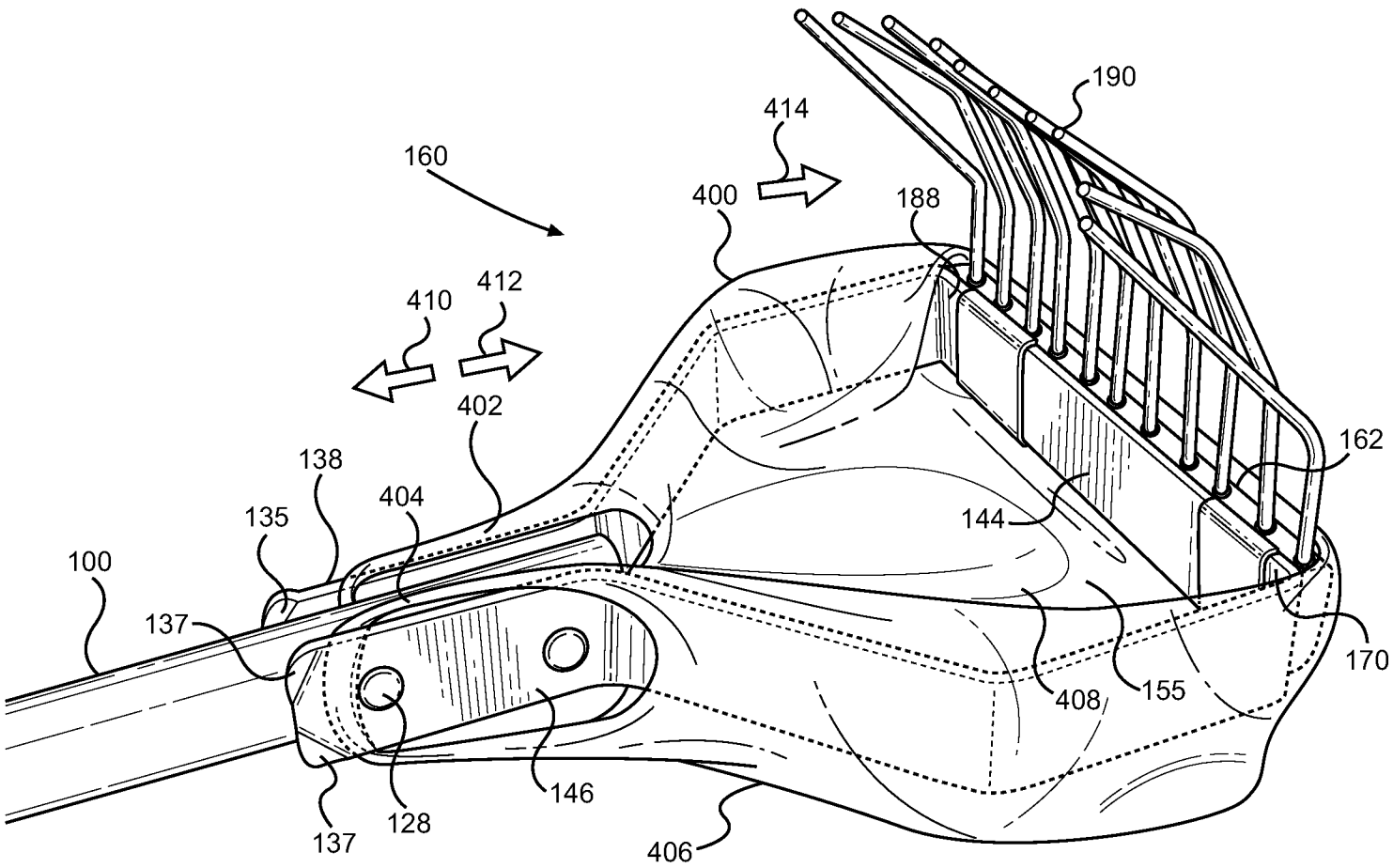
FIG. 11 is a bottom perspective view of the Feces Remover with Quick-Release Head having a disposable grocery shopping bag attached for feces removal.

Referring now to FIG. 11, the Feces Remover 10 is fitted with a disposable grocery shopping bag 400. The disposable grocery shopping bag 400 is a plastic bag having a first handle 402 and a second handle 404 attached to a plastic pouch 406 with an opening 408. As shown, the disposable grocery shopping bag 400 is attached to the Feces Remover 10 by wedging the first handle 402 between the first retaining edge 135 and the handle 100 and the second handle 402 between the second retaining edge 137 and the handle 100. The opening 408 of the pouch 406 is pulled taut against the quick-release head 160 which is attached to the base 144 of the quick-release head receiver 130 with the first quick-release clip 170 and the second quick-release clip 188. The open center 155 of the quick release head receiver 130 opens directly into the pouch 406 of the disposable grocery shopping bag 400. As shown, the Feces Remover 10 is configured to pick up feces and directly deposit the feces into the disposable grocery shopping bag 400. This removes the need for a user to avoid using hands to either collect the feces or open the disposable grocery shopping bag 400 in order to put the feces into it for disposal.

To attach the disposable grocery shopping bag 400 to the quick-release head receiver 130 and the quick-release head 160, the first handle 404 is slipped between the first retaining edge 135 and the handle 100. The first retaining edge 135 provides easy access to wedge the first handle 402 between the first mounting plate 138 of the quick-release head receiver 130 and the handle 100, wherein the fastener 128 prevents further movement down the handle 100. The force of the first mounting plate 138 pressed against the handle 100 with the first handle 402 of the disposable grocery shopping bag 400 between creates sufficient friction force to hold the first handle 402 in place. The second handle 404 is wedged between the second mounting plate 146 of the quick-release head receiver 130 and the handle 100 in substantially the same manner.

After the first handle 402 and the second handle 404 are secured to the Feces Remover 10, the opening of the pouch 406 is placed under the base assembly 162 of the quick-release head 160. The distance 152 between the fasteners 128 and the base 144 provides enough distance to keep the disposable grocery shopping bag 400 taut when the first handle 402 and the second handle 404 are positioned between the first retaining surface 131 and the handle 100 and the second retaining surface 133 and the handle 100 respectively. After placing the pouch 206 under the quick-release head 160, the first handle 402 and the second handle 404 are adjusted and pulled towards direction 210 to pull the pouch 206 taut against the base assembly 162. This ensures the disposable grocery shopping bag 400 is taut against the quick-release head 160 and quick-release head receiver 130, thereby preventing the weight of the feces collected from dislodging the disposable grocery shopping bag 400. The open center 155 of the quick-release head receiver 130 opens directly into the opening 408 of disposable grocery shopping bag 400 allowing any feces picked to be directly deposited into the disposable grocery shopping bag 400.

As the feces is picked up by the quick-release head 160, the configuration of the prongs 190 prevents the feces from falling through the gaps 192. Further, the prongs 190 at the edges prevent the feces held by the prongs 190 from falling off the sides as the prongs 190 at side serve as barriers. The gap 189 further allows the prongs 190 to comb through tall grass to remove feces without getting the prongs 190 stuck. This prevents damage to the grass as well as ease of use as additional force is not required to force the prongs 190 through the grass.

Once an area is removed of feces or the disposable grocery shopping bag 400 is filled with feces, the disposable grocery shopping bag 400 is removed from the Feces Remover 10. To remove the disposable grocery shopping bag 400, the first handle 402 and the second handle 404 of the disposable grocery shopping bag 400 are readjusted in direction 412 until the opening of the pouch 406 is no longer taut around the quick release head 160. Once the disposable grocery shopping bag 400 is no longer taut, the first handle 402 and the second handle 404 are removed from the first retaining edge 135 and the second retaining edge 137, respectively, in direction 410. The disposable grocery shopping bag 400 is then removed and disposed of.

Once the Feces Remover 10 is done being used, the Feces Remover 10 may be disassembled into a compact configuration for storage. To configure the Feces Remover 10 into its compact configuration, the quick-release head 160 is removed from the quick-release head receiver 130. To remove the quick-release head 160 from the quick-release head receiver 130, the quick-release head 160 is pulled in direction 414 with enough force to dislodge the first and second quick-release clips 170 and 188 of the quick-release head 160 from the base 144 of the quick-release head receiver 130. Once the quick-release head 160 is removed, the handle 100 with attached quick-release head receiver 130 and handle 100 may be stored in any area having a space wide enough to accommodate the exterior diameter of the handle 100.

Figure 12:
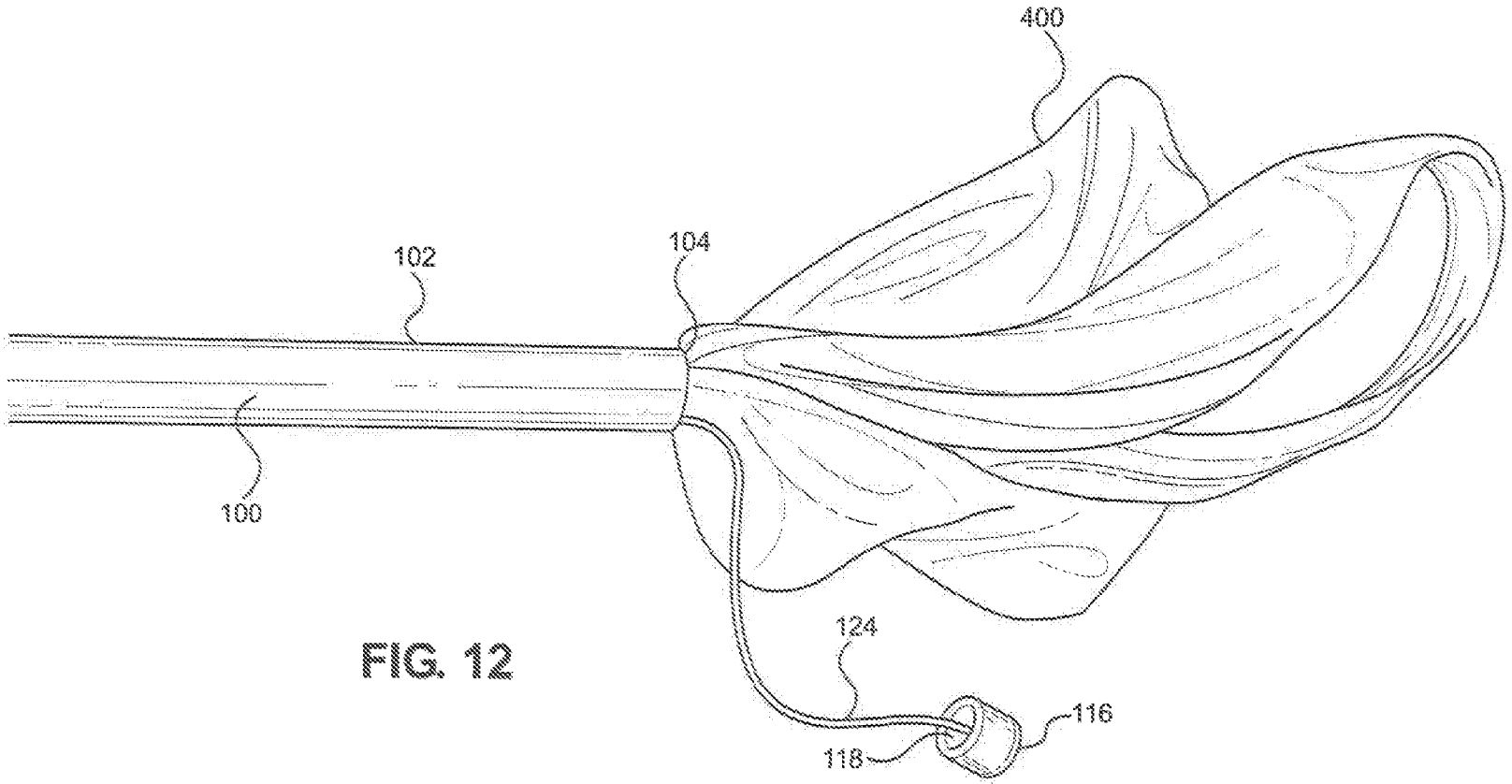
FIG. 12 is a top perspective view of a disposable bag being retrieved from the storage compartment of the handle.

Referring now to FIG. 12, the disposable grocery shopping bag 400 is shown being removed from the interior bore 110 of the tube 102 of the handle 100. The internal bore 110 of the handle 100 is utilized the storage compartment to keep the disposable grocery shopping bags 400. To store or retrieve the disposable grocery shopping bags 400, the cap 116 is removed from the tube 102 to access the internal bore 110. Once the cap 116 is removed, the internal bore 110 is accessible and the disposable grocery shopping bags 400 may either be removed or inserted into the internal bore 110. The storage of the disposable grocery shopping bag 400 ensure that the disposable grocery shopping bag 400 are always accessible. This prevents the need to search for the disposable grocery shopping bag 400 as the disposable grocery shopping bags 400 are stored in the internal bore 110 of the Feces Remover 10.

To ensure the disposable grocery shopping bags 400 stored within the internal bore 110 is able to be retrieved, the plunger 120 (not shown) is placed within the internal bore 110 towards the second end 106 of the tube 102. Removing the cap 116 from the handle 100 pulls the plunger 120 up along the internal bore 110 and pulls the disposable grocery shopping bags 400 held within the internal bore 110 towards the first end 104 of the tube 102. This ensures that all of the disposable grocery shopping bags 400 held within the internal bore 110 is removable. Once the disposable grocery shopping bags 400 is retrieved, the user attaches the disposable grocery shopping bags 400 to the quick-release head receiver 130 and the quick-release head 160.

While the Feces Remover with Quick-Release Head of the present invention as herein shown and disclosed in detail is fully capable of obtaining the objects and providing the advantages herein before stated, it is to be understood that it is merely illustrative of the preferred embodiments of the invention and that no limitations are intended to the details of construction or design herein shown other than as described in the appended claims.

I claim:

1. A feces remover comprising:

a handle;

a quick release head receiver attached to said handle and having a first retaining edge and a second retaining edge;

a quick release head removably attached to said quick release head receiver and having a plurality of prongs extending from said quick release head wherein said prongs have one or more bends wherein said plurality of prongs are further comprising at least two outer prongs each having an outer prong bend and a plurality of inner prongs each having a first inner prong bend and a second inner prong bend; and wherein said outer prong bend has an outer prong bend angle, said first inner prong bend has a first inner prong bend angle and said second inner prong bend has a second inner prong bend angle and wherein said outer prong bend angle is greater than either said first inner prong bend angle or said second inner prong bend angle and said outer prong bend angle is less than a sum of said first inner prong bend angle and said second inner prong bend angle.

2. The feces remover of claim 1 wherein said handle is hollow and capable of storing one or more bags within said handle.

3. The feces remover of claim 2 further comprising a removable cap to secure said bags stored within said handle.

4. The feces remover of claim 3 further comprising a plunger connected to said removable cap by way of a connector.

5. The feces remover of claim 4 wherein said quick release head is attached to said quick release receiver by one or more quick release clips.

6. A feces remover comprising:

a handle;

a quick release head receiver attached to said handle and having a first retaining edge and a second retaining edge;

a quick release head removably attached to said quick release head receiver and having a plurality of prongs extending from said quick release head wherein said prongs have one or more bends wherein said plurality of prongs are further comprising at least two outer prongs each having a first outer prong bend, at least two middle prongs each having a first middle prong bend and a second middle prong bend, and a plurality of inner prongs each having a first inner prong bend and a second inner prong bend; and wherein said outer prong bend has an outer prong bend angle, said first middle prong bend has a first middle prong bend angle, said second middle prong bend has a second middle prong bend angle, said first inner prong bend has a first inner prong bend angle and said second inner prong bend has a second inner prong bend angle and wherein said outer prong bend angle is greater than either said first middle prong bend angle or said first inner prong bend angle and said outer prong bend angle is less than a sum of said first middle prong bend angle and said second middle prong bend angle and said outer prong bend angle is less than a sum of said first inner prong bend angle and said second inner prong bend angle.

7. The feces remover of claim 6 wherein said sum of first middle prong bend angle and said second middle prong bend angle is less than said sum of first inner prong bend angle and said second inner prong bend angle.

8. The feces remover of claim 6 wherein said handle is hollow and capable of storing one or more bags within said handle.

9. The feces remover of claim 8 further comprising a removable cap to secure said bags stored within said handle.

10. The feces remover of claim 9 further comprising a plunger connected to said removable cap by way of a connector.

11. The feces remover of claim 10 wherein said quick release head is attached to said quick release receiver by one or more quick release clips.

12. A feces remover comprising:

a handle;

a quick release head receiver attached to said handle and having a first retaining edge and a second retaining edge;

a quick release head removably attached to said quick release head receiver and having a plurality of prongs extending from said quick release head wherein said prongs have one or more bends wherein said plurality of prongs are further comprising at least two outer prongs each with an outer prong bend, two middle prongs each with a middle prong bend and a plurality of inner prongs each with an inner prong bend; and wherein each said outer prong bend has an outer prong bend angle, each said middle prong bend has a middle prong bend angle and each said inner prong bend has an inner prong bend angle and wherein said outer prong bend angle is greater than either said middle prong bend angle or said inner prong bend angle and said middle prong bend angle is greater than said inner prong bend angle.

13. The feces remover of claim 12 wherein said handle is hollow and capable of storing one or more bags within said handle.

14. The feces remover of claim 12 further comprising a removable cap to secure said bags stored within said handle.

15. The feces remover of claim 14 further comprising a plunger connected to said removable cap by way of a connector.

16. The feces remover of claim 14 wherein said quick release head is attached to said quick release receiver by one or more quick release clips.

17. The feces remover of claim 16 wherein said prongs are further comprising at least two first outer prongs each having a first outer prong bend, at least two second outer prongs with each having a second outer prong bend, and a plurality of inner prongs with each having a first inner prong bend and a second inner prong bend.

* * * * *